US007507051B2

(12) United States Patent
McCue et al.

(10) Patent No.: US 7,507,051 B2
(45) Date of Patent: Mar. 24, 2009

(54) ADJUSTABLE BOLLARD

(75) Inventors: David S. McCue, Manchester, MA (US); Daniel B. Ballou, Salem, MA (US); Adam P. Stevens, York, ME (US); Brent Hild, Belmont, MA (US); Teodoro A. Mesa, Lynn, MA (US); Genesis J. McDermott, Chicago, IL (US)

(73) Assignee: McCue Corporation, Salem, MA (US)

( * ) Notice: Subject to any disclaimer, the term of this patent is extended or adjusted under 35 U.S.C. 154(b) by 0 days.

(21) Appl. No.: 11/800,233

(22) Filed: May 4, 2007

(65) Prior Publication Data

US 2007/0248410 A1 Oct. 25, 2007

Related U.S. Application Data

(63) Continuation-in-part of application No. 11/633,935, filed on Dec. 5, 2006.

(60) Provisional application No. 60/742,660, filed on Dec. 6, 2005.

(51) Int. Cl.
*E01F 15/00* (2006.01)

(52) U.S. Cl. ..... 404/9; 404/6; 404/11; 49/49; 49/50

(58) Field of Classification Search ..... 404/6, 404/9–11; 256/13.1; 49/49, 50
See application file for complete search history.

(56) References Cited

U.S. PATENT DOCUMENTS

| | | | | |
|---|---|---|---|---|
| 1,999,920 | A | 4/1935 | Wolfson | |
| 3,952,453 | A | 4/1976 | Amburgey | |
| 4,198,036 | A | 4/1980 | O'Neal | |
| 5,011,326 | A | 4/1991 | Carney, III | |
| 5,033,905 | A | 7/1991 | Schmidt et al. | |
| 5,507,473 | A | 4/1996 | Hammer et al. | |
| 5,566,926 | A | 10/1996 | Voigt | |
| 5,891,534 | A | 4/1999 | Sabin et al. | |
| 5,899,628 | A * | 5/1999 | Pei-Chi | 404/9 |
| 6,203,241 | B1 * | 3/2001 | Gertz | 404/6 |
| 6,260,237 | B1 | 7/2001 | McCue et al. | |

(Continued)

FOREIGN PATENT DOCUMENTS

| | | |
|---|---|---|
| FR | 2424982 | 11/1979 |

(Continued)

OTHER PUBLICATIONS

International Search Report for Application No. PCT/US2006/046406, dated Mar. 29, 2007.

*Primary Examiner*—Raymond W Addie
(74) *Attorney, Agent, or Firm*—Lahive & Cockfield, LLP

(57) ABSTRACT

An adjustable bollard protects structures from collisions with objects and limits access to particular areas. The bollard includes a rigid post body and a leg structure secured to the rigid body. The leg structure includes at least two leg portions adapted to support the rigid post body, where the two leg portions are separated by a predetermined distance. The bollard further includes an adjustment mechanism coupled to the rigid body, the two leg portions, or both. The adjustment mechanism is configured to apply a force to the rigid post body to flex the rigid body to adjust the predetermined distance for installation of the at least two leg portions. The bollard is constructed of material with sufficient strength and toughness to withstand collisions with heavier industrial type equipment.

16 Claims, 14 Drawing Sheets

U.S. PATENT DOCUMENTS

| | | | | |
|---|---|---|---|---|
| 6,579,034 | B1 | 6/2003 | Welch et al. | |
| 6,619,630 | B2 | 9/2003 | Albritton | |
| 6,623,204 | B2 * | 9/2003 | Buehler | 404/6 |
| 6,848,857 | B1 | 2/2005 | McColl et al. | |
| 6,945,730 | B1 | 9/2005 | Lobban et al. | |
| 2005/0152744 | A1 | 7/2005 | Straub | |
| 2007/0031189 | A1 | 2/2007 | Stadler | |

FOREIGN PATENT DOCUMENTS

| | | |
|---|---|---|
| GB | 2207692 | 2/1989 |

* cited by examiner

ADJUSTABLE BOLLARD

RELATED APPLICATIONS

The present invention is a continuation-in-part of U.S. patent application Ser. No. 11/633,935 filed Dec. 5, 2006, and entitled "Adjustable Rigid Corner Guard", the contents of which are herein incorporated by reference.

FIELD OF THE INVENTION

The present invention relates generally to a bollard for protecting structures from moving objects, controlling or directing a flow of traffic of heavy equipment, carts or vehicles, and/or blocking access to particular areas, and relates more particularly to a bollard employing a rigid body with an extended vertical height and legs for mounting the bollard having an adjustable distance therebetween.

BACKGROUND OF THE INVENTION

In supermarkets and retail stores floor fixtures such as freezer and refrigerator cases, floor shelving, and product displays are susceptible to damage due to collisions with shopping carts, floor scrubbers, pallet jacks, stock carts, and the like. For example, freezer and refrigerator cases typically include a glass or transparent plastic door for viewing the product without opening the door. The glass can be shattered, or the plastic scratched, upon impact with shopping carts, or the like. Since the body of many of these floor fixtures is constructed of lightweight aluminum or hardened plastic, it can be easily dented or cracked by such impacts.

A bollard is commonly used to protect floor fixtures from collisions with shopping carts and heavy equipment. Bollards are also commonly employed inside a store to block shopping cart access to certain areas and outside a store to protect outdoor structures from collisions, to indicate parking areas, to block vehicle and heavy equipment access to a particular area, and to direct a flow of traffic. Bollards can also be used to block vehicular access for security reasons. While some bollards are permanently fixed in place, others need to be removable to temporarily permit access to an area, or when a change in location is required.

Bollards can be difficult to mount to a floor or to the ground, often requiring large diameter holes or cement to be held in place. The large diameter hole for mounting a bollard can be difficult to make in the floor or in asphalt, concrete, etc., and if the bollard is removed, the very large diameter hole in the floor, in a sidewalk or in a parking lot is a hazard. Bollards held in place with cement are not easily installed and are not easily removed. Alternatively, a bollard can be mounted using two or more smaller posts in the form of a leg structure that is attached to the body of the bollard. The posts of the leg structure fit into two smaller holes in the floor or the ground. If the bollard is removed, the two small holes in the floor or the ground do not present as great a hazard. The two smaller holes are easier to form in the floor or ground than the single large diameter hole, however, unlike the single large diameter hole that does not require precise positioning, the two smaller mounting holes must be precisely spaced for the two posts to align with the two smaller mounting holes. The bollard with legs requires a significant degree of precision when one is forming the mounting holes into which the legs are positioned to install the bollard. If the mounting holes are not precisely spaced, the pair of legs may not fit well, and/or may not fit at all.

Accordingly, what is needed is a bollard for use where collisions with other equipment may occur, while also providing some degree of adjustment with regard to the installation of the bollard. The present invention is directed to this need.

SUMMARY OF THE INVENTION

An embodiment of the present invention is a bollard for protecting floor fixtures from collision with objects, providing a barrier to carts, vehicles or heavy equipment, guiding a flow of traffic, etc. The bollard includes a rigid post body. The rigid post body has a base portion at a first end and a top portion at a second opposite end. The bollard also includes a leg structure secured to the rigid post body proximal to the base portion. The leg structure includes at least two leg portions adapted to support the rigid post body of the bollard and the at least two leg portions are separated by a predetermined distance. The bollard also includes an adjustment mechanism coupled to the rigid post body and/or the at least two leg portions. The adjustment mechanism is configured to apply a force to the rigid post body to flex the rigid post body to adjust the predetermined distance for installation of the at least two leg portions.

According to aspects of the present invention, the rigid post body can be formed of a material with a tensile yield strength of greater than about 150 MPa. The rigid post body can be formed of a composite material. The rigid post body can be formed of a metal. For example, the rigid post body can be formed of a steel.

According to further aspects of the present invention, a cross-section of the rigid post body, viewed along a central axis of the rigid post body, can be substantially circular or elliptical. A cross-section of the rigid post body, viewed along a central axis of the rigid post body, can be substantially polygonal.

According to other aspects of the present invention, the leg structure can be secured to an inner side of a wall of the rigid post body. The rigid post body can be secured to the leg structure by at least one weld. The rigid post body can further include at least one slot parallel to a central axis of the rigid post body. The at least one weld securing the rigid post body to the leg structure is disposed at the at least one slot.

According to additional aspects of the present invention, the at least two leg portions can be joined by the adjustment mechanism. The adjustment mechanism can be configured to apply a force to the bollard to flex the rigid post body to increase or decrease the predetermined distance. The adjustment mechanism can be adapted to apply a force to the bollard to flex the rigid post body to adjust the predetermined distance by a distance of at least about 0.50 inches.

According to further aspects of the present invention, the adjustment mechanism can include a cylindrical portion with a first end, a second end, and a cylindrical axis extending through the center and along the length of the cylindrical portion. The cylindrical portion is threaded in a first orientation at a first end and is reverse threaded at a second end. The adjustment mechanism can further include a first coupling configured to couple the threaded first end of the cylindrical portion with the rigid post body and a second coupling configured to couple the threaded second end of the cylindrical portion with the rigid post body. Rotation of the cylindrical portion about the cylindrical axis in a first direction applies a force to flex the rigid post body to reduce the predetermined distance and rotation of the cylindrical portion about the cylindrical axis in a second direction applies a force to flex the rigid post body to increase the predetermined distance.

According to other aspects of the present invention, the rigid post body can further include at least one access hole that allows access to the adjustment mechanism. The bollard can further include a cover adapted to cover the rigid post body and block access to the at least one access hole. The bollard can further include ballast contained within the rigid post body.

BRIEF DESCRIPTION OF THE DRAWINGS

The present invention will become better understood with reference to the following description and accompanying drawings, wherein.

DETAILED DESCRIPTION

Figure 1:
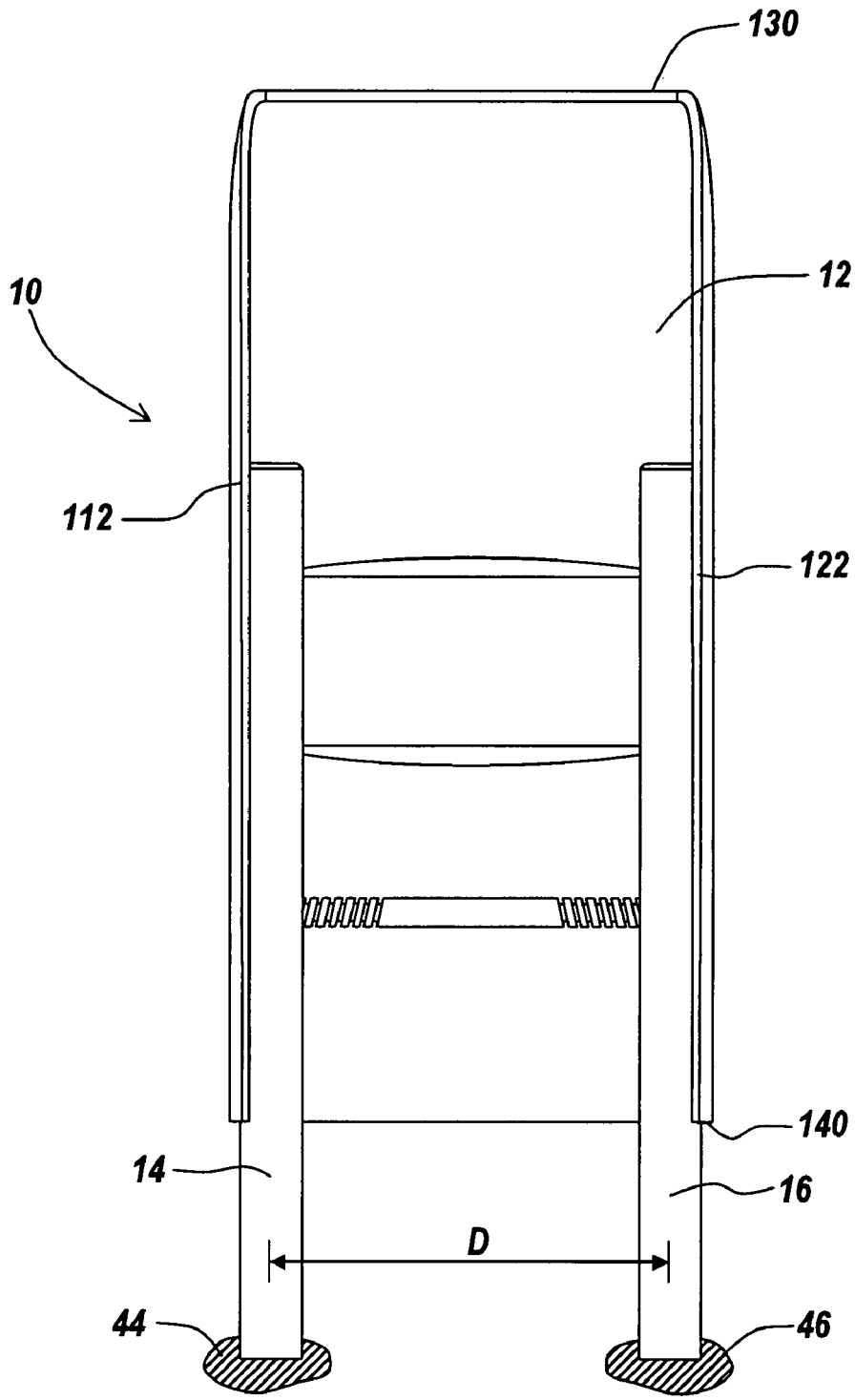
FIG. 1 is a diagrammatic back view of an adjustable rigid corner guard, according to one aspect of the present invention.
Figure 2:
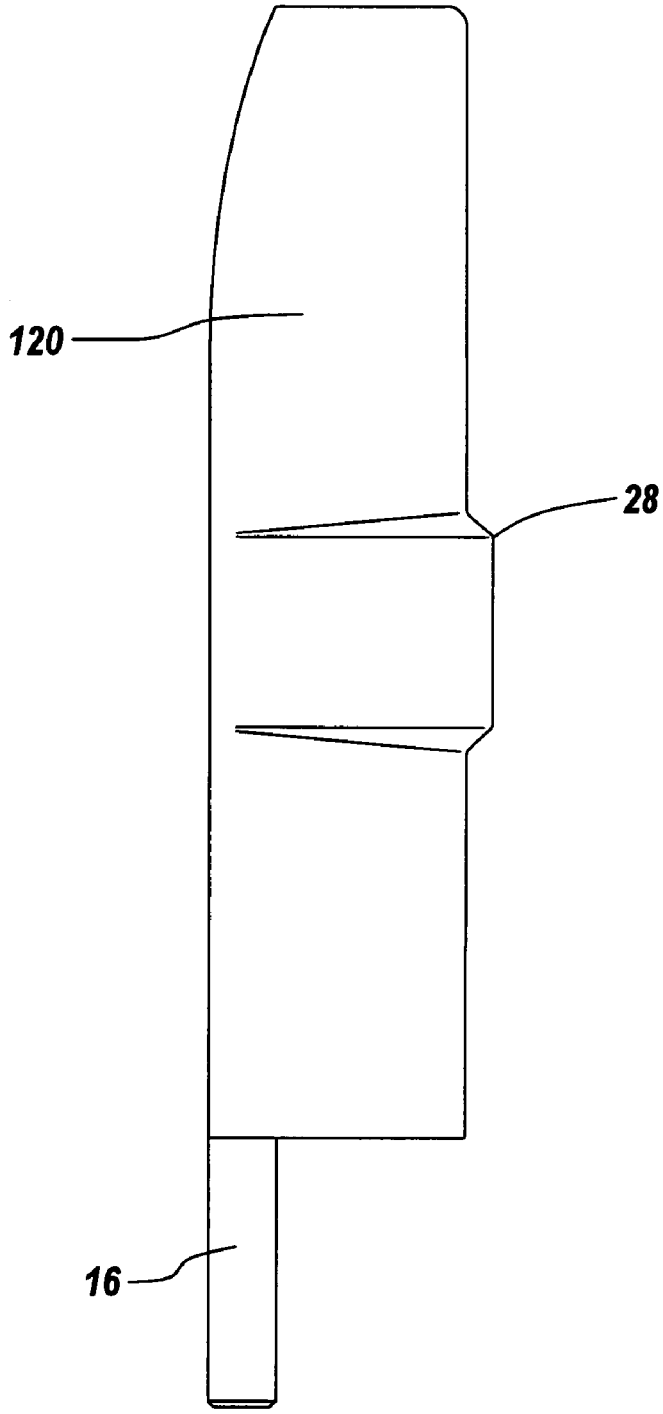
FIG. 2 is a diagrammatic side view of the adjustable rigid corner guard, according to one aspect of the present invention.

An illustrative embodiment of the present invention relates to an adjustable bollard in which one embodiment is formed of a rigid post body to absorb impact forces. The rigid body is constructed of a material, such as a metal or heavy composite for ease of cleaning and for good stability and impact absorption ability. Other types of material are considered within the scope of the invention. The material must be sturdy enough to absorb the impact of many collisions while maintaining an attractive appearance, and not easily fracturing or denting. One embodiment of the present invention further includes at least two leg portions that support the rigid post body. The distance dimension between the leg portions is adjustable to enable minor variations in the placement of the mounting holes into which the leg portions fit to install the bollard in the ground or floor.

FIGS. 1 through 7B, wherein like parts are designated by like reference numerals throughout, illustrate an example embodiment of an adjustable corner guard according to the present invention and FIGS. 8A through 13 illustrate example embodiments of an adjustable bollard according to the present invention. Although the present invention will be described with reference to the example embodiments illustrated in the figures, it should be understood that many alternative forms can embody the present invention. One of ordinary skill in the art will additionally appreciate different ways to alter the parameters of the embodiments disclosed, such as the size, shape, or type of elements or materials, in a manner still in keeping with the spirit and scope of the present invention.

FIG. 1 is a back view of an adjustable rigid corner guard 10 in accordance with one embodiment of the present invention. The adjustable rigid corner guard 10 has a bumper section 12, which serves to protect a corner upon which, or in front of which, the adjustable rigid corner guard 10 is mounted. The bumper section 12 can be formed of a number of different rigid and high strength materials, such as metal and high strength composites, and the like, to create a rigid body, so long as the material provides sufficient support and durability to protect a corner. The ability of a particular material to resist being dented or cracked when impacted with an object depends on the yield strength of the particular material (the force a material can withstand before being irreversibly deformed) and the facture toughness of the particular material (the material's resistance to brittle fracture when a crack is present). A material must have sufficient strength to resist being dented or deformed to be useful as a rigid corner guard. The tensile yield strength, expressed in units of millions of Pascals (MPa), is a standard measure of material strength. A material with sufficient strength may not be suitable for use as a corner guard because it may not be sufficiently tough. Such a material would not dent or deform during a collision, but it would crack. The fracture toughness, expressed in units of millions of Pascals multiplied by square root meters (MPa-$m^{1/2}$), is a standard measure of material toughness. The yield strength is normally expressed in units of millions of Pascals (MPa) and the fracture toughness is normally expressed in units of millions of Pascals multiplied by square root meters (MPa $\sqrt{m}$ or MPa-$m^{1/2}$).

In accordance with one example embodiment, the bumper section 12 is formed of a stainless steel metal. Table 1 shows yield strengths for readily available stainless steels, a common aluminum alloy, a common cold-rolled steel alloy, a range for all carbon steels, and two types of high density polyethylene (HDPE). As described above, many conventional corner guards are formed of plastics such as HDPE and lightweight aluminum. However, most plastics and many aluminum alloys do not have sufficient strength for use in a corner guard where collisions with heavier industrial type equipment can occur. The yield strength of most metal materials (pure and alloys) depends both on the chemical composition of the metal material and the way that the metal material is processed. Cold working and/or annealing of a metal material can greatly increase its strength. For this reason, typical values of yield strength for a particular metal material composition may cover a large range.

As can be seen in Table #1, aluminum alloys are much stronger than plastics, such as impact resistant HDPE. Some aluminum alloys are as strong as some types of stainless steel alloys, but the range of strengths is higher for stainless steel than for aluminum alloys. Additionally, stainless steel alloys are more tough (resistant to fracture) than aluminum alloys.

TABLE #1

| Material | Tensile Yield Strength in MPa | Fracture Toughness ($K_{1C}$) in MPa-$m^{1/2}$ |
|---|---|---|
| Stainless Steel AISI type 300 series | 210-415 (range includes 304, 304L, 304N and 304HN) | 100 (typical value for AISI 300 series) |
| Al alloy 6061-T6 | 276 (typical value) | 29 (typical value) |
| Cold Rolled Steel Common alloy 1008 | 180-240 | |
| Range for all Carbon Steels | 140-2750 | |
| High Density Polyethelene (HDPE), impact grade | 17-25 MPa (typical values) | ~1 |
| HDPE, ultra high molecular weight | 20-28 MPa (typical values) | ~1 |

Materials with a tensile yield strength of greater than about 190 Mpa and a fracture toughness greater than about 40 MPa-$m^{1/2}$ are sufficiently strong and tough to withstand collisions with heavier industrial type collisions when used to form the bumper section 12.

The adjustable rigid corner guard 10 further includes two or more legs, such as a first leg 14 and a second leg 16, upon which the bumper section 12 rests. The first and second legs 14, 16 are preferably fabricated from stainless steel to provide strength when the bumper section 12 receives an impact blow. Other materials may, of course, be utilized as long as the appropriate strength is retained, and first and second legs 14, 16 do not break under predictable impact. The first and second legs 14, 16 are spaced a distance D apart.

Figure 3A:
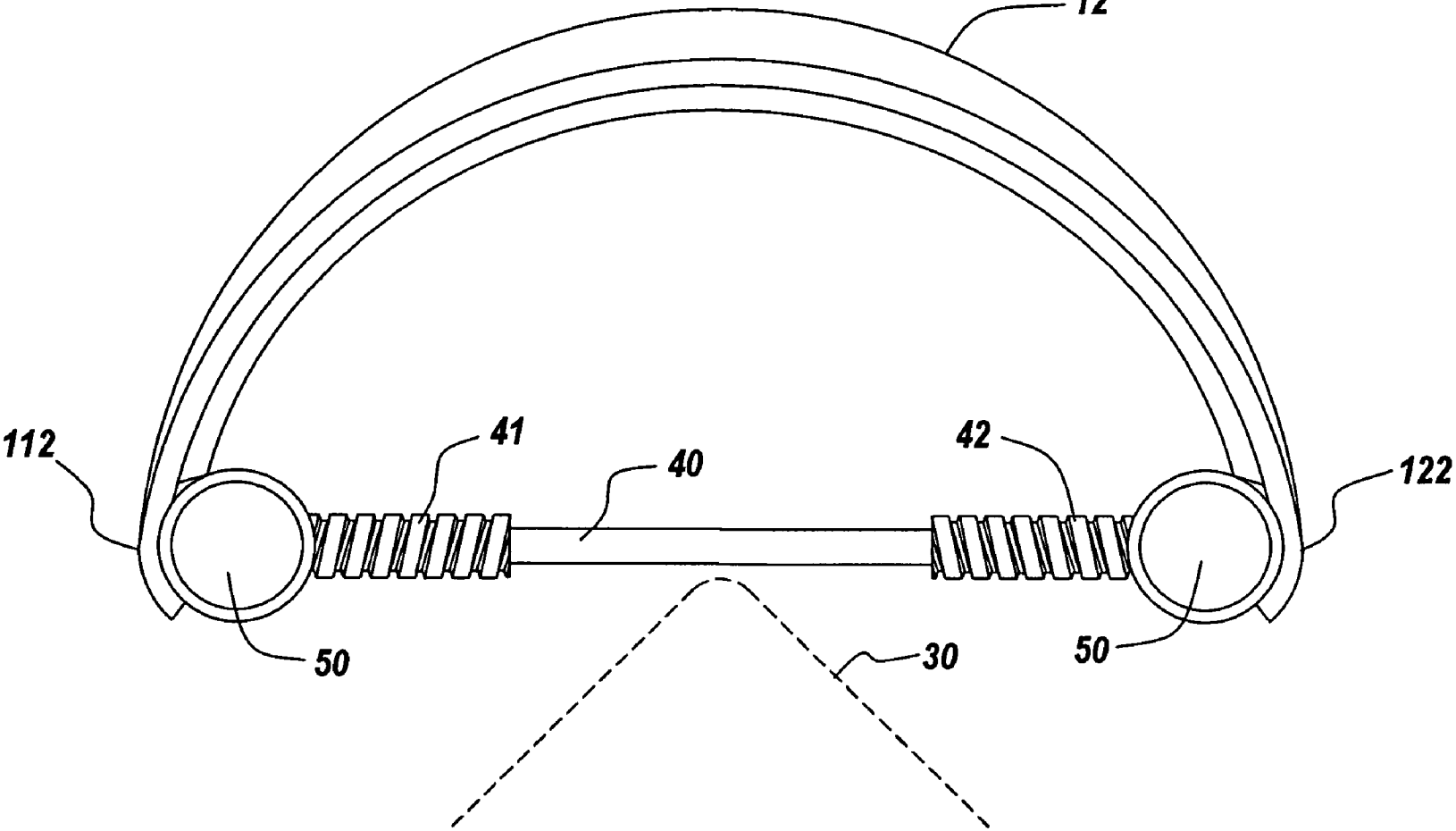
FIG. 3A is a diagrammatic top view of the adjustable rigid corner guard, according to one aspect of the present invention.
Figure 3B:
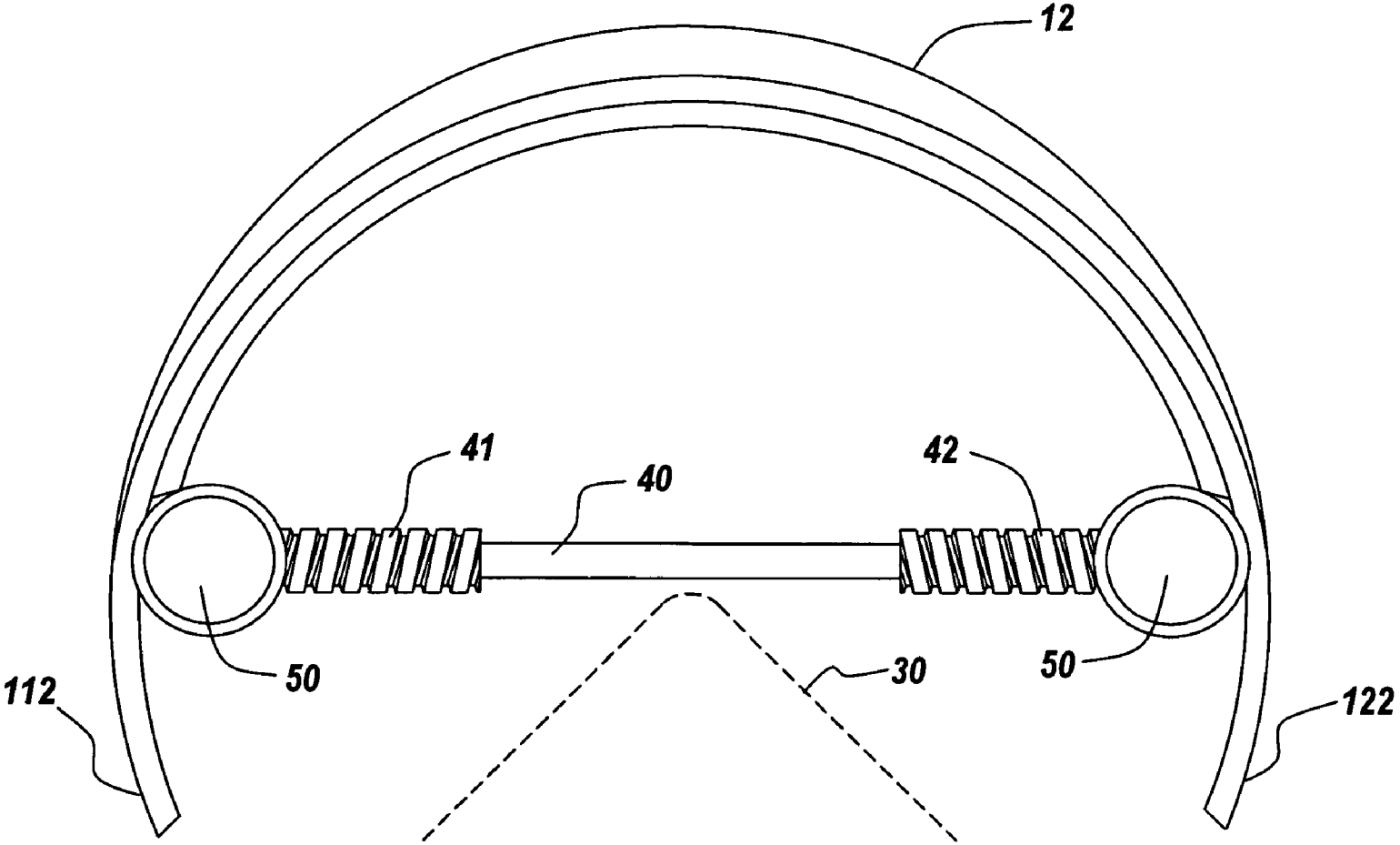
FIG. 3B is a diagrammatic top view of the adjustable rigid corner guard where a bumper section extends laterally significantly beyond a leg structure, according to one aspect of the present invention.
Figure 4A:
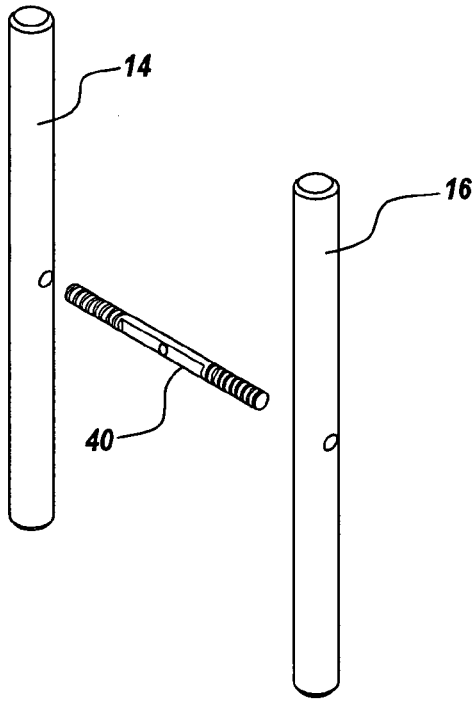
FIG. 4A is an exploded perspective view of the legs and adjustment mechanism of the corner guard, according to one aspect of the present invention.
Figure 4B:
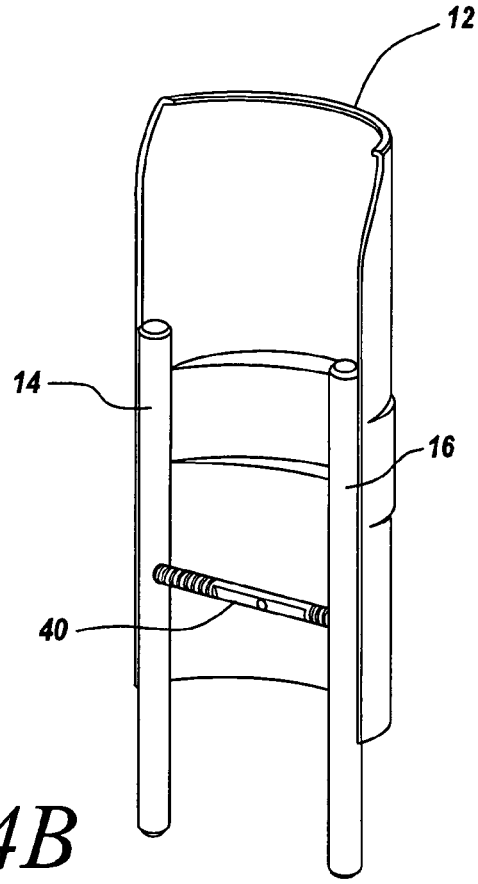
FIG. 4B is a perspective view of the legs and adjustment mechanism of the corner guard assembled, according to one aspect of the present invention.

The adjustable rigid corner guard 10 can have a number of different configurations, while still providing the desired level of protection of a corner upon which, or in front of which, it mounts. Referring now to FIGS. 1-7B, one example embodiment will now be described. Primarily, the adjustable rigid corner guard 10 is configured for absorbing the impact of collisions and protecting corners of fixtures and/or walls. The bumper section 12 includes a front right side face 110 and a front left side face 120. The front right side face 110 and front left side face 120 are essentially opposite ends of a generally arcuate shaped horizontal cross-section. However, the front right side face 110 and front left side face 120 can likewise be substantially orthogonal to each other and meet in a rounded edge in-between; or alternatively may intersect at other angles other than the perpendicular, so as to surround the periphery of a corner 30. Both the front right side face 110 and the front left side face 120 provide an extended vertical surface to protect the corner 30 adequately. A right side edge 112 and a left side edge 122 are preferably beveled, as is a top 130 of the bumper section 12, and also a base 140, in order to eliminate any sharp edges on the adjustable rigid corner guard 10. However, other types of edge finishes are considered within the scope of the invention. The front wall, formed by the front right side face 110 and front left side face 120, essentially surrounds the corner 30 of a structure that is to be protected. Additionally, the bumper section 12 can extend laterally substantially beyond the leg structure as shown in FIG. 3B. This obscures the view of the back side of the bumper section 12 of the adjustable rigid corner guard 10 after installation, and may provide a greater area of protection for the corner 30 of the structure.

In accordance with one example embodiment of the present invention, the adjustable rigid corner guard 10 includes a rub rail 28 that extends horizontally across the front right side face 110 to the front left side face 120 of the adjustable rigid corner guard 10. The rub rail 28 runs parallel to the base and forms a bulge or outwardly projecting surface feature in the front of the bumper section 12, extending outwardly from the front wall, to receive the initial impact of any collision. The rub rail 28 is integral with the bumper section 12. It should be noted that the configuration of the rub rail 28 can vary, such that other type protrusions, such as a wedge or rectangular bulge, can form the rub rail 28 within the scope of the present invention, such that the rub rail 28 is not limited to the configuration illustrated herein.

Figure 5:
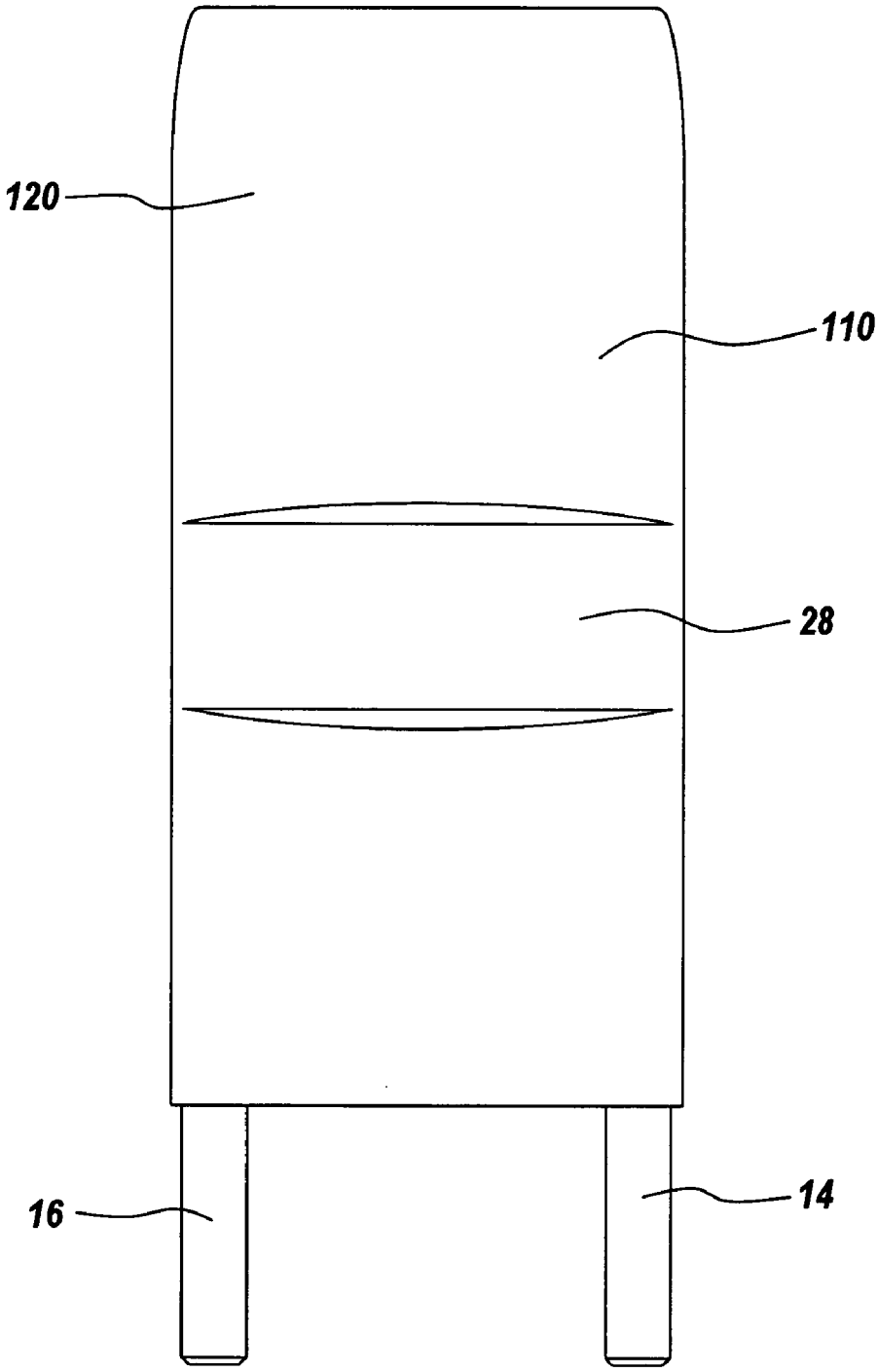
FIG. 5 is a front view of the adjustable rigid corner guard with a rub rail, according to one aspect of the present invention.
Figure 6:
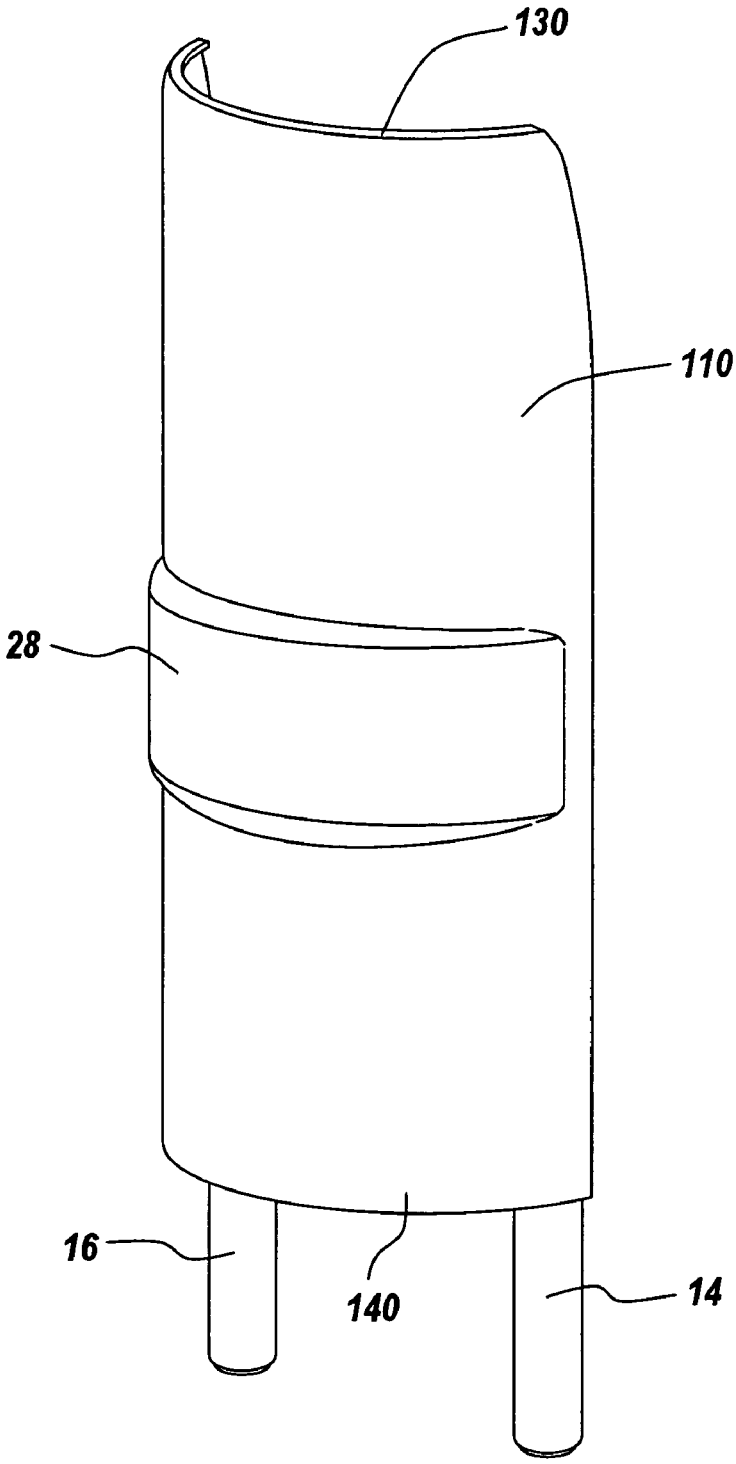
FIG. 6 is a perspective view of the front of the adjustable rigid corner guard, according to one aspect of the present invention.

Referring now to FIGS. 5 and 6, the vertical height of bumper section 12 is designed to be substantially larger than the width of either the front right side face 110 or the front left side face 120. The rub rail 28, which extends horizontally across the front right side face 110 and the front left side face 120 is positioned a short distance up from the base, and protrudes a short distance out from the respective front right and left side faces 110 and 120.

Referring back to FIG. 3, FIG. 4A, and FIG. 4B, there is shown a top view of the adjustable rigid corner guard 10, and two perspective views. The difficulty in making a corner guard with a rigid body that is strong enough to withstand impacts from heavy machinery or objects, potentially at higher velocities, is that the installation of such a guard can be hindered by slight variances in the distance between the mounting holes into which the legs of the guard are placed. With a softer material used to form the main body of the corner guard, the body can be compressed or slightly deformed to adjust the distance between the two or more legs to enable them to fit in existing mounting hose. However, if the body is too rigid (to withstand greater impacts) it can be very difficult to still maintain some flexibility in the placement of the mounting holes relative to the distance between the supporting legs of the guard. With the present invention, an adjustment mechanism 40 is provided that includes a rod with opposite orientation threading 41, 42. In the example embodiment illustrated, the rod of the adjustment mechanism 40 extends between the right side edge 112 and left side edge 122 of the bumper section 12. The adjustment mechanism 40 couples with the right side edge 112 and left side edge 122 at couplings 50. The couplings 50 can be fixed or can provide some rotation or pivoting capability, if desired, to allow rotation about a vertical axis through the couplings. The adjustment mechanism 40 includes the opposite orientation threading 41, 42, which operates to pull the right side edge 112 and left side edge 122 closer together when rotated in a first direction, and to push the right side edge 112 and left side edge 122 farther apart when rotated in an opposite direction.

With the rotation of the adjustment mechanism 40 in the first direction to pull the right and left side edges 112, 122 together, contemporaneous movement of the first and second legs 14, 16 occurs, and the distance D therebetween is reduced. With the rotation of the adjustment mechanism 40 in the opposite second direction to push the right and left side edges 112, 122 apart, contemporaneous movement of the first and second legs 14, 16 occurs, and the distance D therebetween is increased.

One of ordinary skill in the art will appreciate that the first and second leg supports 18, 20 can take a number of different forms, and are merely intended to provide sufficient support coupling the bumper section 12 with the first and second legs 14, 16 in a manner that will allow the adjustable rigid corner guard 10 to receive predictable impact levels from carts, and the like, as described, while protecting the corner 30 in front of which the adjustable rigid corner guard 10 is mounted.

The primary function of the adjustment mechanism 40 is to couple the front right side face 110 and the front left side face 112 together in a manner that enables or allows for a flexing of the bumper section 12 of the adjustable rigid corner guard 10 to affect the distance D between the first and second legs 14, 16 when installing the adjustable rigid corner guard 10. The flexing of the bumper section 12 along provides both increasing and decreasing adjustment of the distance D between the first leg 14 and the second leg 16. As such, if during an installation process, mounting holes 44 and 46 into which the first leg 14 and the second leg 16 are intended to fit are not precisely spaced at the exact distance between the first leg 14 and the second leg 16 without flexing the bumper section 12, then a user performing the installation can adjust the distance D as necessary using the adjustment mechanism 40.

Specifically, during installation, the distance D can be adjusted by an installer by applying a force to the front right side face 110 and the front left face section 112, either expanding them apart to increase distance D or compressing them together to decrease distance D. Thus, if any minor adjustments are required based on the placement of the mounting holes 44, 46 in the ground, the installer can flex the bumper section 12 using the adjustment mechanism 40, to line up the first and second legs 14, 16 to match up with the mounting holes 44, 46.

It should be noted that in the illustrative embodiment the first and second legs 14, 16 are welded to the bumper section 12 of the adjustable rigid corner guard 10. Accordingly, the adjustable rigid corner guard 10 maintains superior strength and impact resistance properties to plastic bumpers, while still having the ability to accommodate minor installation misalignments.

In accordance with one example embodiment, several adjustable rigid corner guards 10 were constructed. The bumper sections 12 ranged between 12 inches in height, to 18 inches in height, to 24 inches in height. With such dimensions, the flexibility provided by the adjustment mechanism 40 enabled variation of the dimension D between the first and second legs 14, 16 on the order of about ¼ inch in each direction (increasing and decreasing).

Figure 7A:
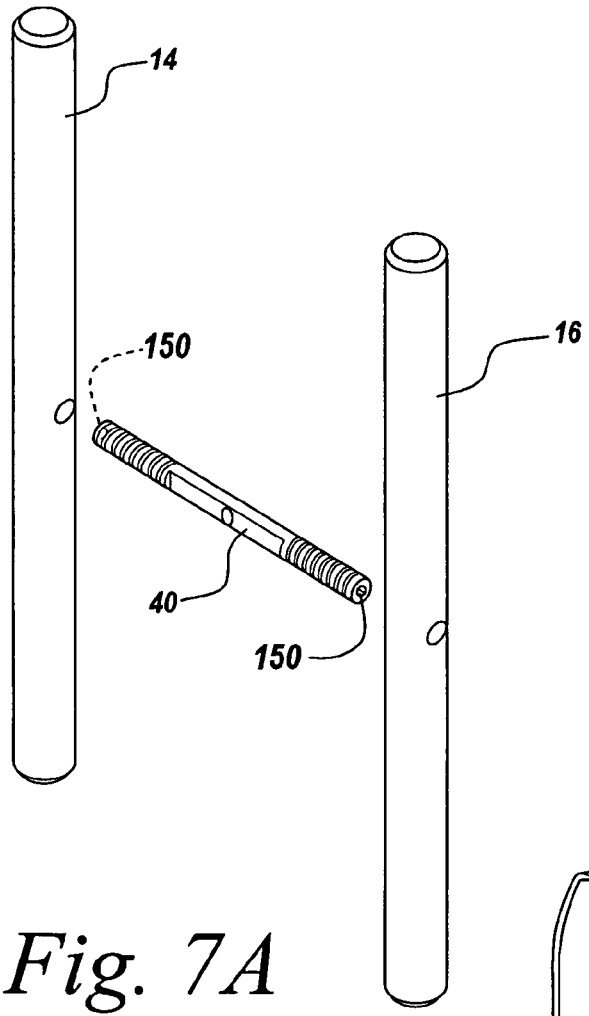
FIG. 7A is an exploded perspective view of the legs and adjustment mechanism of the corner guard where the adjustment mechanism includes hexagonal sockets, according to one aspect of the present invention.
Figure 7B:
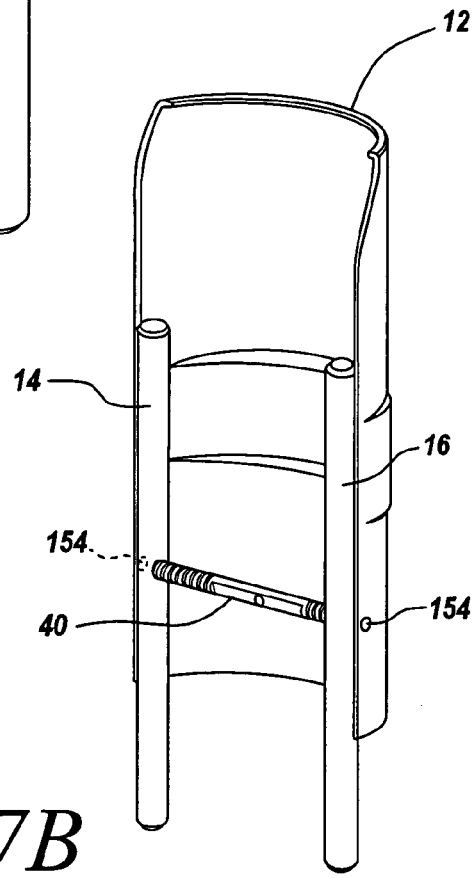
FIG. 7B is a perspective view of the legs, adjustment mechanism, and the bumper section of the corner guard assembled where the bumper section includes adjustment access holes, according to one aspect of the present invention.

Another illustrative embodiment shown in FIGS. 7A and 7B, allows the installer to change the distance D from a front of the bumper section 12, without necessarily requiring access to a back of the bumper section 12. The adjustment mechanism 40 has hexagonal sockets 150 at both ends that allow rotation of the adjustment mechanism 40 using a hexagonal wrench or an allen wrench. The bumper section 12 has adjustment access holes 154 that allow access to the hexagonal sockets 150 from the front side of the bumper section 12. An installer could move the adjustable rigid corner guard 10 to near its installed position and then change the distance D from the front side of the bumper section 12 using a hexagonal wrench or an allen wrench. After the adjustable rigid corner guard 10 is installed, the adjustable rigid corner guard 10 could be secured or "locked into position" by changing the distance D, causing transverse frictional forces between the first and second legs 14, 16 and the sides of the holes in which they are mounted.

Another illustrative embodiment of the present invention is an adjustable bollard described in FIGS. 8A-13. The adjustable bollard has a rigid post body that can absorb impact forces from heavy equipment or vehicles. The adjustable bollard also has a leg structure secured to the rigid post body to facilitate installation by requiring relatively small mounting holes. A distance between leg portions of the leg structure is adjustable, reducing the precision required for placement of the mounting holes, and, reducing the difficulties associated with installation. Additionally, changing the distance between leg portions after the bollard has been installed allows the bollard to be "locked" in place.

Figure 8C:
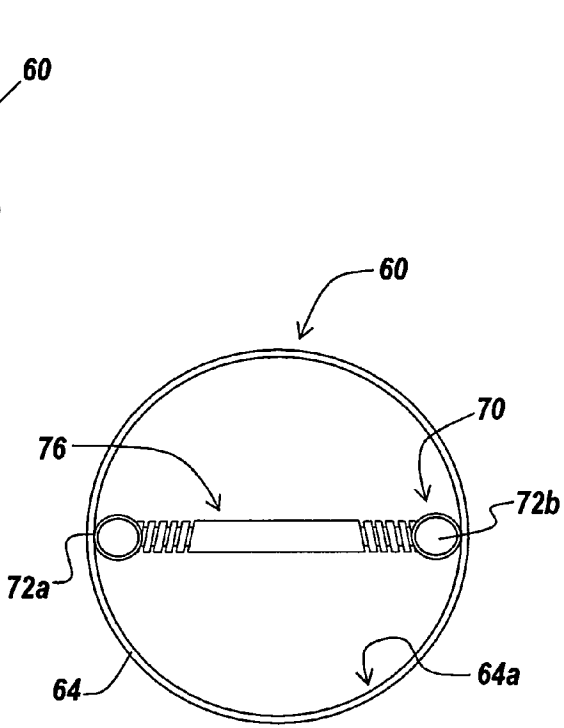
FIG. 8C is an enlarged diagrammatic top view of the bollard depicted in FIG. 8A.
Figure 8B:
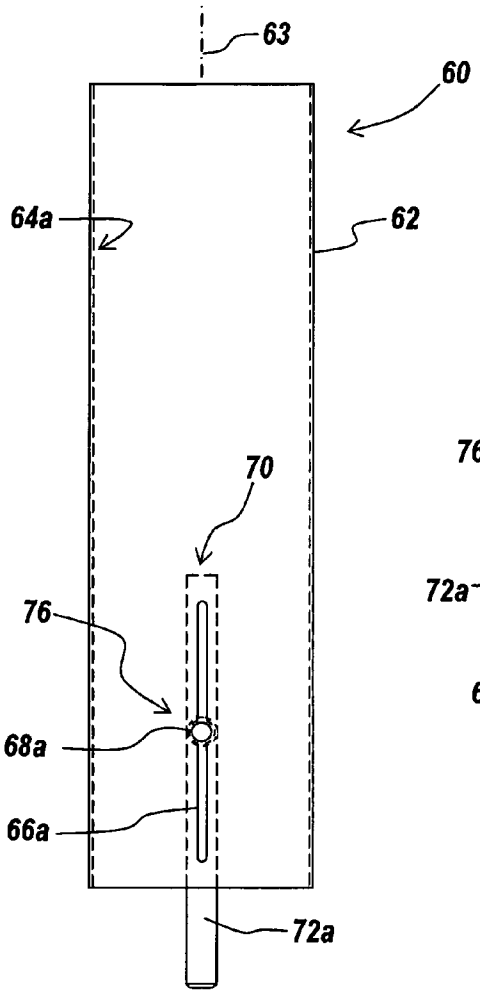
FIG. 8B is a diagrammatic side view of the bollard depicted in FIG. 8A.
Figure 8A:
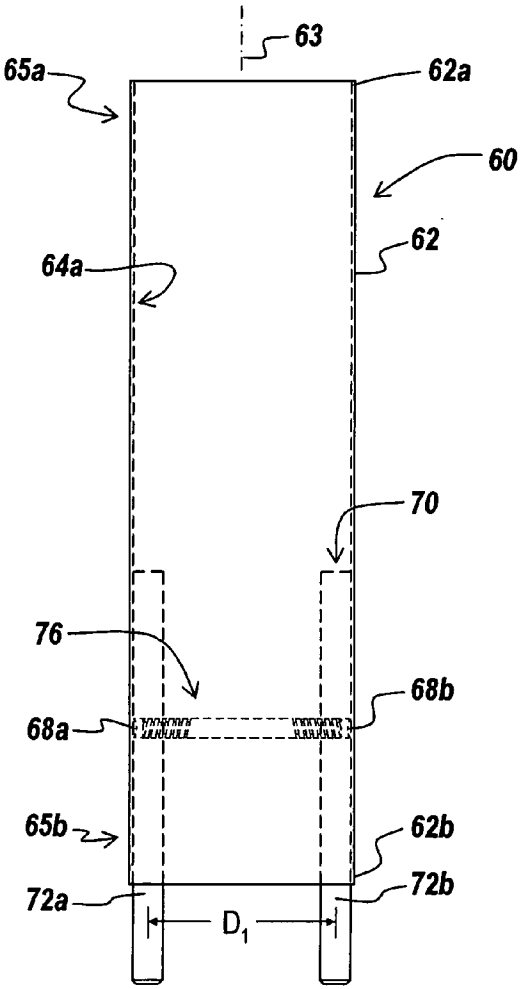
FIG. 8A is a diagrammatic front view of an adjustable bollard that is another illustrative embodiment of the present invention.

FIGS. 8A through 8C depict different views of an illustrative adjustable bollard 60 in accordance with one embodiment of the present invention. The adjustable bollard 60 includes a rigid post body 62 with a top end 62*a* and a bottom end 62*b*, and a leg structure 70 secured to the rigid post body 62 proximal to a base portion 65*b* of the rigid post body 62. The leg structure 70 can be secured to an inner side 64*a* of a wall 64 of the rigid post body 62. The leg structure 70 includes at least two leg portions 72*a*, 72*b* that are separated by a predetermined distance $D_1$. The adjustable bollard 60 also includes an adjustment mechanism 76 that is coupled to the rigid post body 62 and/or the at least two leg portions 72*a*, 72*b*. The adjustment mechanism 76 is configured to apply a force to the rigid post body 62 to flex the rigid post body 62 (either directly or through the at least two leg portions 72*a*, 72*b*) to adjust the predetermined distance $D_1$ for installation of the at least two leg portions 72*a*, 72*b*.

An adjustable bollard 60 of the present invention, must withstand impacts from heavy equipment. The adjustable bollard 60 can be formed of a number of different rigid and high strength materials, such as metal and high strength composites, so long as the material provides sufficient support and durability to withstand an impact with heavy equipment. The material of the rigid post body 62 must be sturdy enough to absorb the impact of many collisions while maintaining an attractive appearance, and not easily fractured or dented. The rigid post body 62 of the adjustable bollard 60 can be formed of a steel, a composite material or another material with a high yield stress, preferably a material with a tensile yield strength of greater than about 150 MPa. For example, as shown in table 1, series 300 alloys of stainless steel, and 1008 steel, a popular alloy for cold-rolled steel, both have sufficient tensile strength. A suitable material must also be sufficiently tough to prevent fracture. Additionally, the structural details, such as wall thickness, and material properties of the rigid post body 62 must be selected such that the rigid post body 62 can adequately flex in response to a force exerted using the adjustment mechanism 76.

Figure 13:
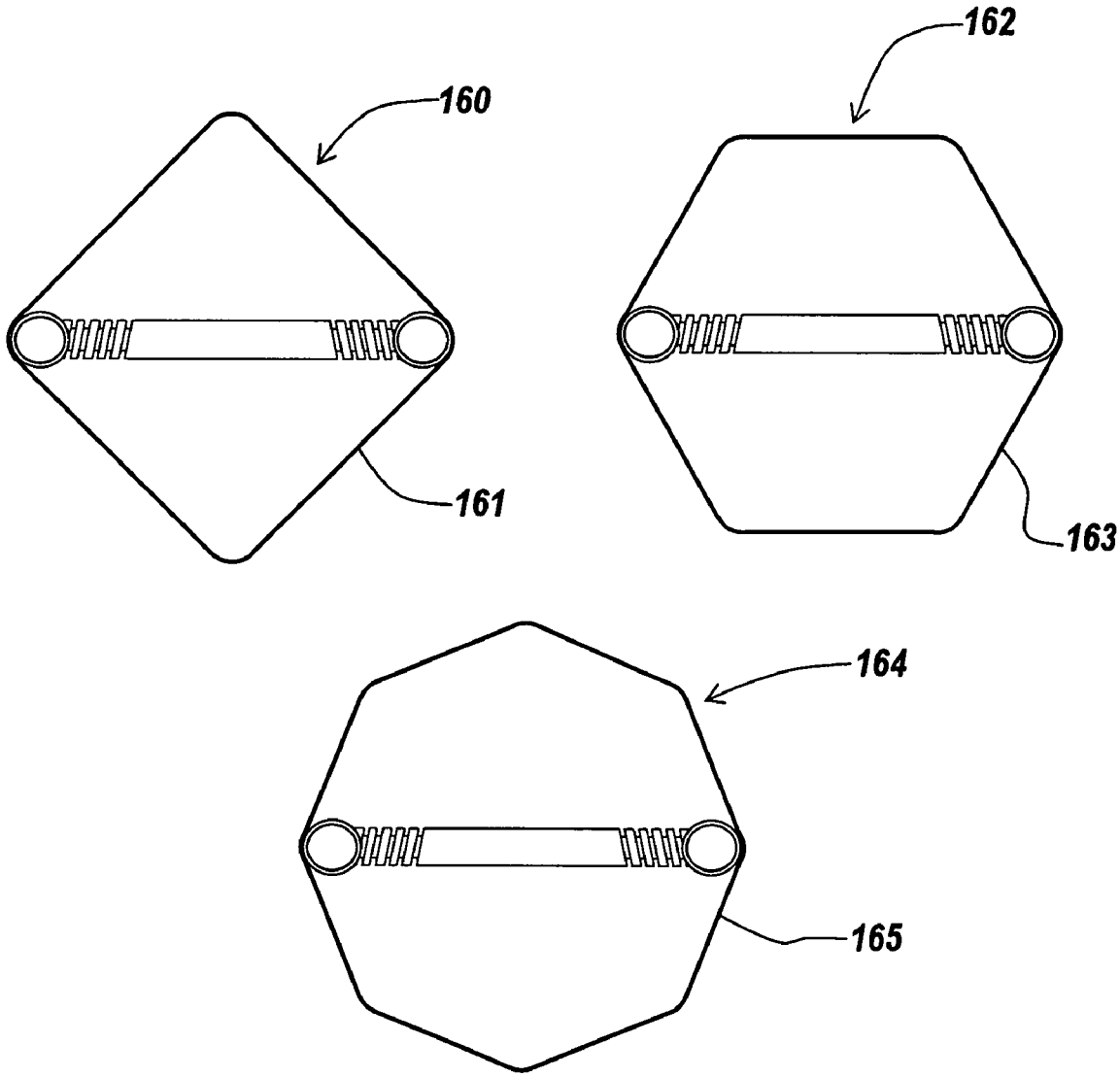
FIG. 13 diagrammatically depicts top views of embodiments of the bollard with polygonal rigid post body cross-sections, according to aspects of the present invention.

FIG. 8C depicts an enlarged top view of the adjustable bollard 60 viewed along a central axis 63 of the rigid post body 62. Although the illustrative adjustable bollard 60 has a rigid post body 62 with a circular or elliptical cross-section viewed along the central axis 63, other embodiments of an adjustable bollard may have polygonal cross-sections of the rigid post body, as shown in FIG. 13. One of ordinary skill in the art will appreciate that any number of different cross-sectional configurations are possible. Thus, the present invention is by no means limited to the specific examples shown.

Figure 9B:
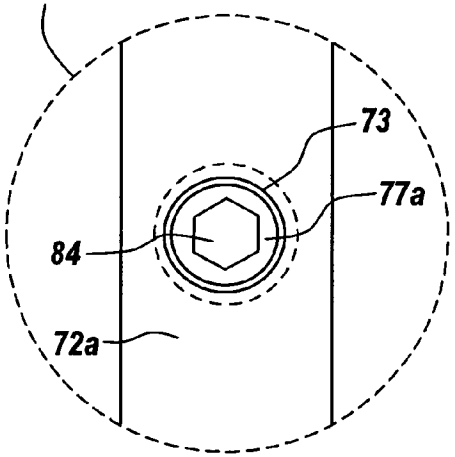
FIG. 9B is an enlarged diagrammatic view of a portion of the leg structure along a central axis of a cylindrical portion.
Figure 9A:
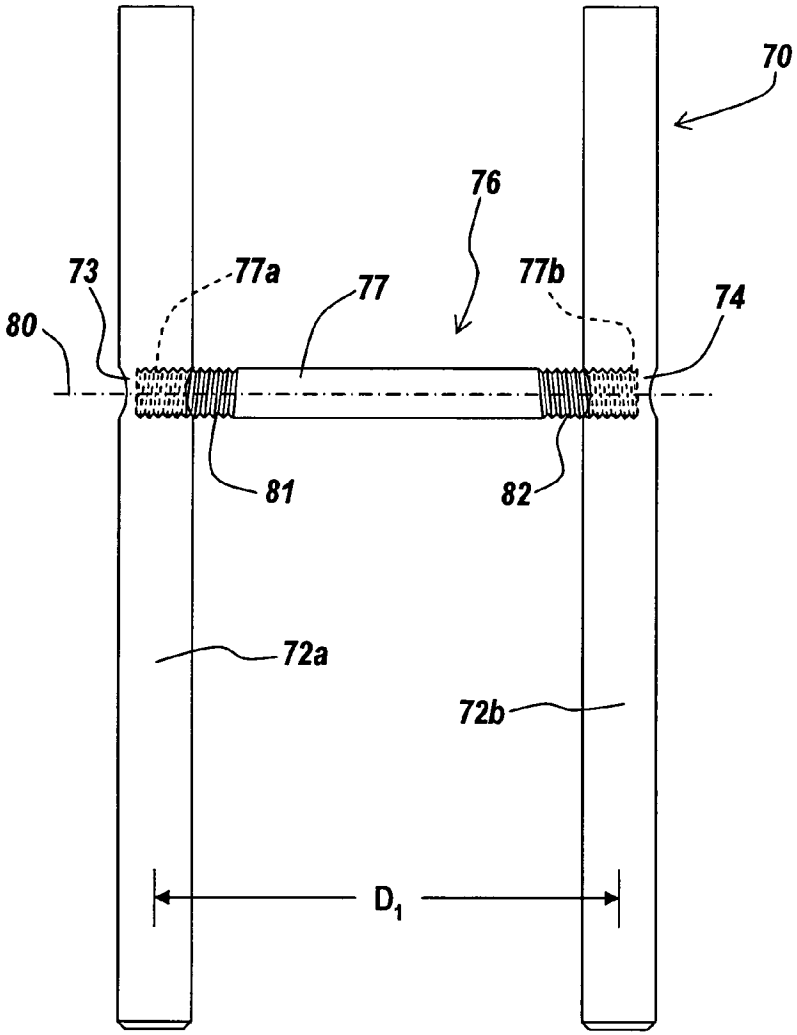
FIG. 9A is a diagrammatic front view of a leg structure, according to aspects of the present invention.

FIGS. 9A and 9B diagrammatically illustrate details of the leg structure 70 and the adjustment mechanism 76. The leg structure 70 and the adjustment mechanism embodiments of the adjustable bollard can include any aspects of the first leg 14, the second leg 16, and the adjustment mechanism 40 of the adjustable rigid corner guard 10 discussed previously and depicted in FIGS. 4A and 7A. As shown in FIG. 9A, an illustrative leg structure 70 comprises two leg portions 72*a* and 72*b* separated by the predetermined distance $D_1$. Although the illustrative leg structure 70 has two leg portions 72*a* and 72*b*, an adjustable bollard with a leg structure having more than two leg portions, with correspondingly more predetermined distances between them, falls within the scope of the present invention.

As shown, the two leg portions 72*a* and 72*b* can be joined by the adjustment mechanism 76, however, the adjustment mechanism 76 can instead be coupled with the rigid post body 62 or can be coupled with both the leg portions 72*a*, 72*b* and the rigid post body 62, according to aspects of the present invention. The adjustment mechanism 76 can include a cylindrical portion 77 that is threaded 81 in a first orientation at a first end 77*a* and that is reverse threaded 82 at a second end 77*b*. A cylindrical axis 80 extends through the center of the cylindrical portion 77 and along a length of the cylindrical portion 77. The first leg portion 72*a* can include a threaded hole 73 configured to mate with the threaded first end 77*a* of the cylindrical portion 77. The threaded hole 73 forms a first coupling that couples the threaded first end 77*a* of the cylindrical portion 77 to the rigid post body 62. The second leg portion 72*b* can include a reverse threaded hole 74 configured to mate with the reverse threaded second end 77*b* of the cylindrical portion 77, The threaded hole 74 forms a second coupling that couples the reverse threaded second end 77*b* of the cylindrical portion 77 to the rigid post body 62. Rotation of the cylindrical portion 77 about the cylindrical axis 80 in a first direction applies a force to flex the rigid post body 62 to reduce the predetermined distance $D_1$. Rotation of the cylindrical portion 77 about the cylindrical axis 80 in an opposite direction applies a force to flex the rigid post body 62 to increase the predetermined distance $D_1$. The adjustment range will depend on the materials used, the overall size of the bollard and the size of the predetermined distance.

In accordance with one particular example embodiment, an adjustable bollard, with a rigid post body made from a cold-rolled steel, has a predetermined distance $D_1$ of about 4.6 inches that can be increased or decreased by about 0.25 inches, resulting in a total adjustment range of about 0.5 inches. The adjustment range for each embodiment will depend on the materials used, the overall size of the bollard and the size of the predetermined distance.

An enlarged portion 90 of the leg structure 70 and adjustment mechanism 76 viewed along the cylindrical axis 80 is depicted in FIG. 9B. The threaded hole 73 in the first leg portion 72*a* allows the cylindrical portion 77 to be accessed through the leg portion 72*a*. As shown, the first end 77*a* of the cylindrical portion 77 can have a hexagonal shaped recess 84 that allows the cylindrical portion 77 to be rotated relative to the leg portions 72*a*,72*b* using a hexagonal key or a hexagonal-head wrench 102 (also see FIGS. 11A to 11C). The illustrative cylindrical portion 77 has a hexagonal shaped recess 84 on the first end 77*a* and another hexagonal shaped recess 84 on the second end 77*b* end to allow adjustment from either side. One of skill in the art will recognize that many other mechanisms that would adjust the predetermined distance $D_1$ fall within the scope of the present invention.

Figure 10B:
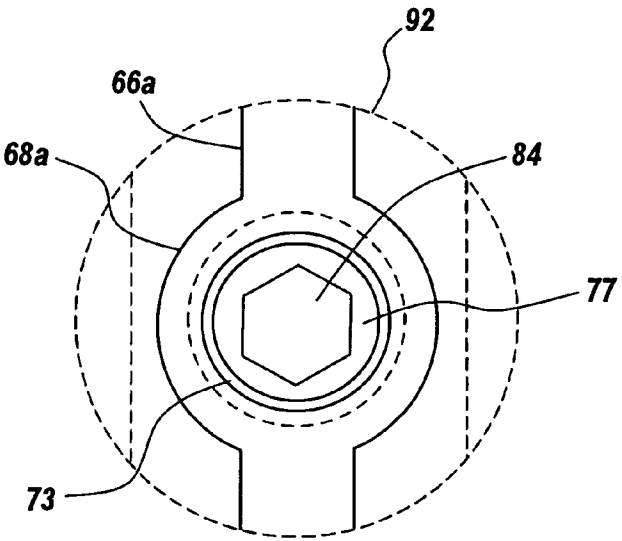
FIG. 10B is a further enlarged side view of a portion of the bollard depicted in FIG. 10A.
Figure 10A:
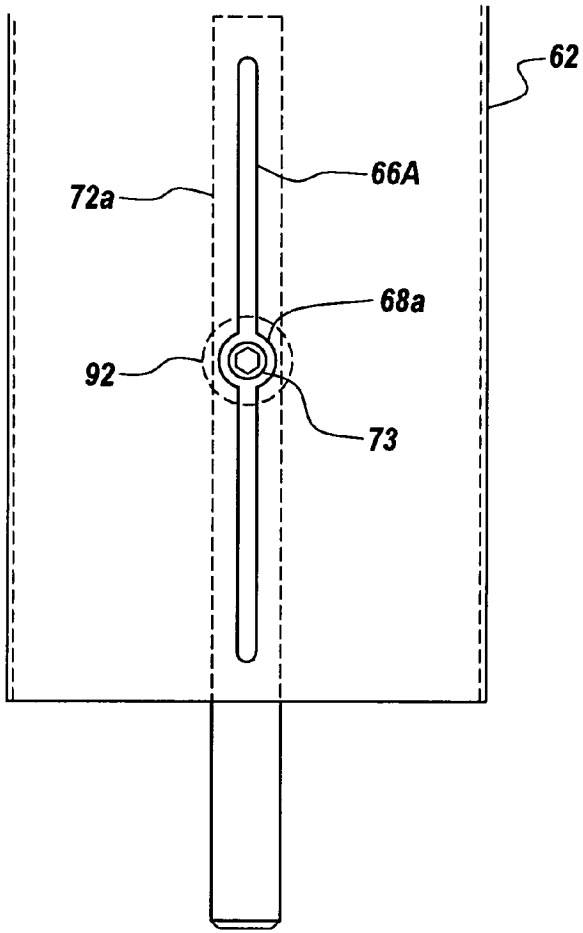
FIG. 10A is an enlarged diagrammatic side view of a portion of the bollard depicted in FIG. 8A.

FIG. 10A depicts an enlarged a side view of a portion of the adjustable bollard 60. According to aspects of the present invention, the rigid post body 62 can have at least one slot 66*a* parallel to the central axis 63 and at least one access hole 68*a* (see also FIG. 8B). The slot 66*a* allows the leg portion 72*a* to be secured to the rigid post body 62 using a plug welding technique. The leg portion 72*a* can be welded to the rigid post body 62 all along the length of the slot 66*a* except where an access hole 68*a* is located. Alternately, any other suitable technique or method could be employed to secure the leg portions 72*a*, 72*b* to the rigid body. The access hole 68*a* in the rigid post body 62 allows access to the adjustment mechanism 76 to change the predetermined distance $D_1$.

FIG. 10B depicts a further enlarged view of a portion 92 of the adjustable bollard 60. To change the predetermined distance, a hexagonal-head wrench 102 (see also FIGS. 11A through 11C) is inserted through the access hole 68*a* in the rigid post body 62, through the threaded hole 73 in the first leg portion 72*a*, and into the hexagonal shaped recess 84 in the first end 77*a* of the cylindrical portion 77, which forms a part of the adjustment mechanism 76. Rotating the hexagonal-head wrench 102 in one direction reduces the predetermined distance $D_1$. Rotating the hexagonal-head wrench 102 in an opposite direction increases the predetermined distance $D_1$.

Figure 11B:
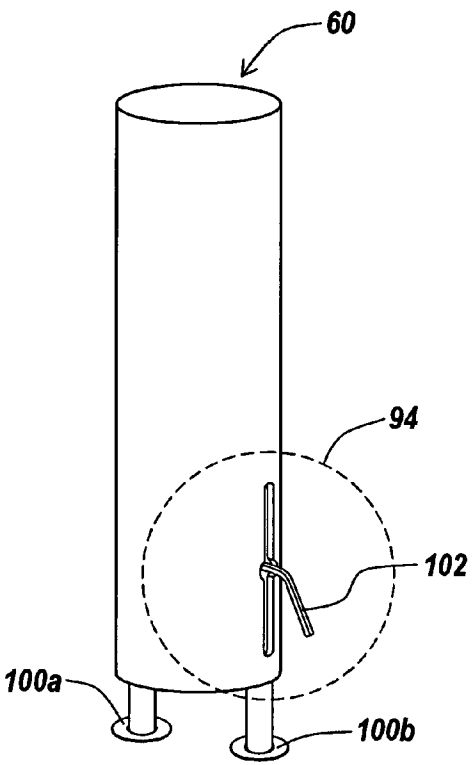
FIG. 11B diagrammatically illustrates the bollard after installation.
Figure 11C:
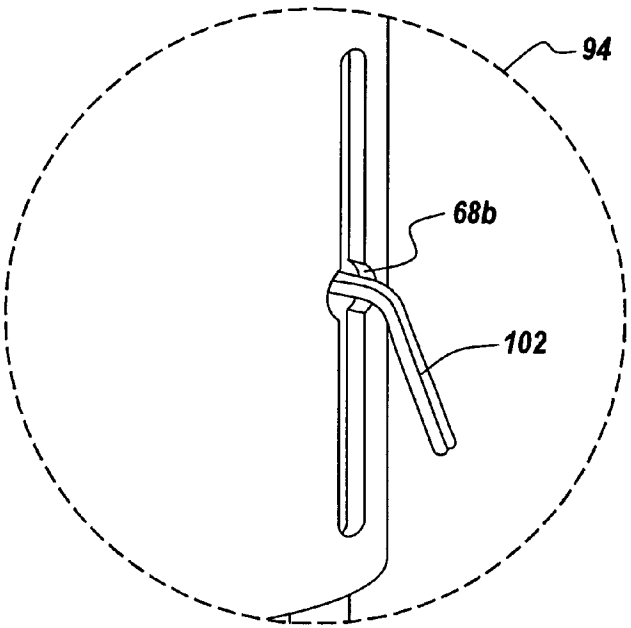
FIG. 11C is an enlarged view of a portion of the bollard after installation.
Figure 11A:
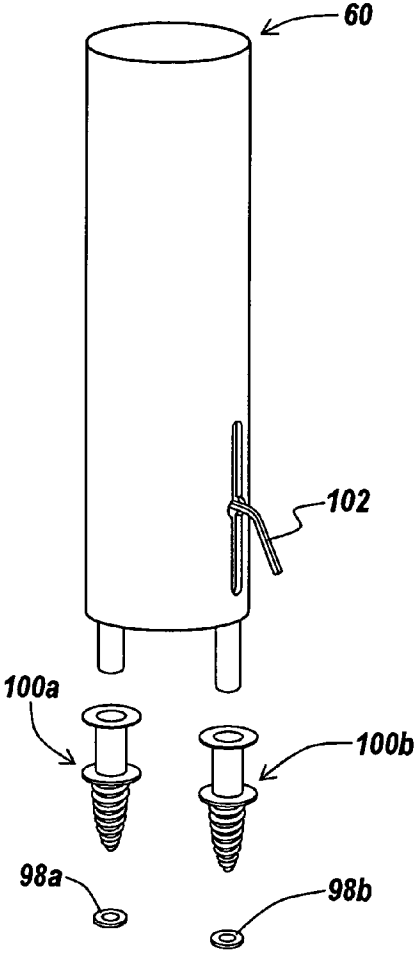
FIG. 11A diagrammatically illustrates installation of the bollard using floor anchors, according to one aspect of the present invention.

FIGS. 11A to 12B depict installation of the illustrative embodiment of the adjustable bollard 60. The leg portions 72*a*, 72*b* can be inserted directly into mounting holes 98*a*, 98*b* holes made in the floor or the ground (as shown in FIG. 12A), or alternately, the leg portions 72*a*, 72*b* can be inserted into drive anchors 100*a*, 100*b* which have been inserted in the mounting holes 98*a*, 98*b* in the floor or ground, as shown in FIGS. 11A and 11B. An example of a suitable drive anchor appears in U.S. Pat. No. 6,991,413. If the two mounting holes 98*a*, 98*b* are not precisely spaced at the exact distance between the first leg portion 72*a* and the second leg portion 72*b*, then a user performing the installation can adjust the distance $D_1$ as necessary using the adjustment mechanism 76. FIG. 11C depicts an enlarged view 94 of the allen wrench coupled with the adjustment mechanism 76 for adjusting the distance $D_1$. After the leg portions 72*a*, 72*b* have been inserted into the mounting holes 98*a*, 98*b*, or into the drive anchors 100*a*, 100*b* in the mounting holes 98*a*, 98*b* (as shown in FIG. 11B), the distance $D_1$ between the leg portions 72*a*, 72*b* can be adjusted to secure or "lock" the bollard in place through the transverse frictional forces between the leg portions 72*a*, 72*b* and the sides of the mounting holes 98*a*, 98*b* in which they are mounted.

Figure 12A:
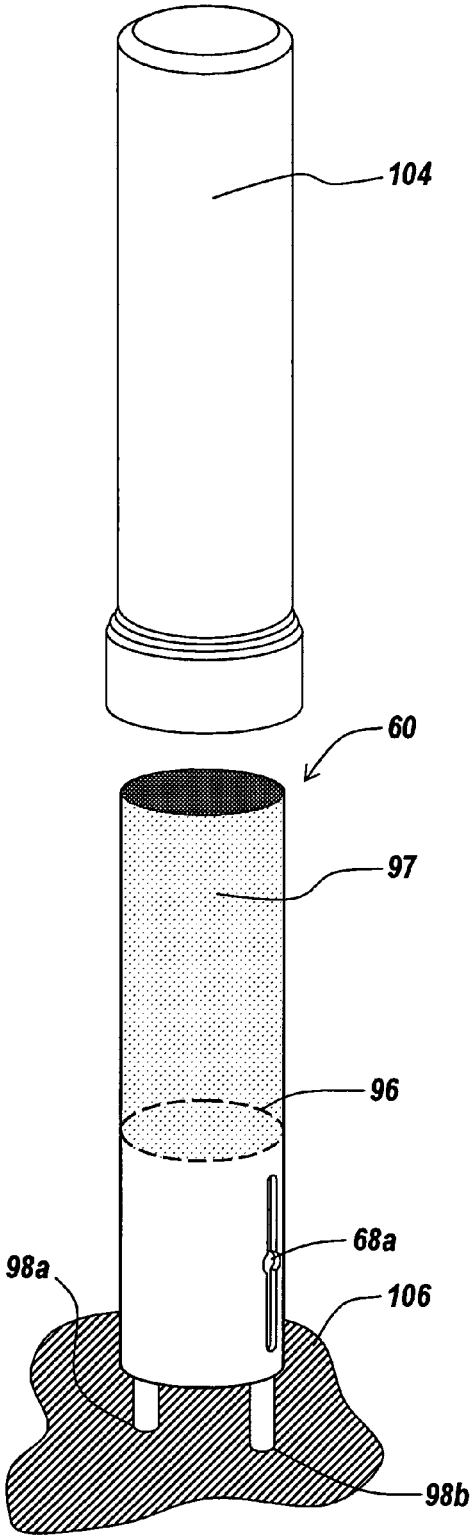
FIG. 12A diagrammatically illustrates use of a bollard cover according to an aspect of the present invention.
Figure 12B:
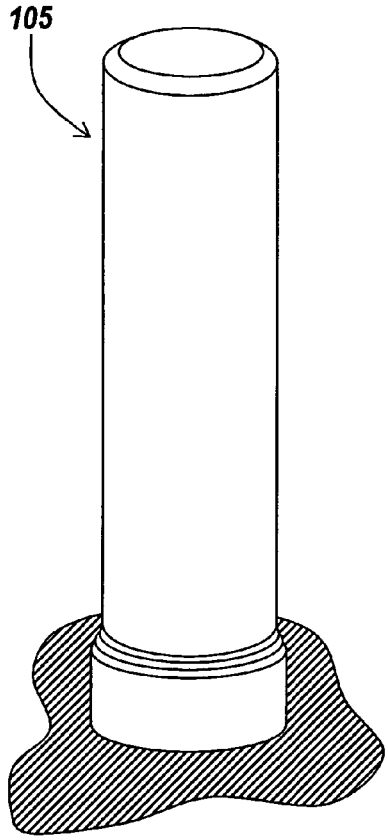
FIG. 12B diagrammatically illustrates the bollard after installation and after being covered with a bollard cover.

After the leg portions 72*a*, 72*b* are inserted into the mounting holes 98*a*, 98*b* and the adjustable bollard 60 has been locked into place (if desired), the hexagonal-head wrench 102 is removed, ballast 97 can be added and a bollard cover 104 can be placed on the adjustable bollard, as shown in FIGS. 12A and 12B. According to aspects of the present invention, the adjustable bollard can include ballast 97 such as concrete, sand, water. etc. to increase the mass of the adjustable bollard 60 and to increase its resistance to denting. As shown in FIG.

12A, the rigid post body 62 can include a shelf 96 that forms the bottom of a container for containing the ballast 97. The ballast 97 can be contained in the adjustable bollard 60 before installation, or the ballast 97 may be added to the adjustable bollard 60 after installation. According to other aspects of the present invention, a bollard cover 104 can be placed over the top of the rigid post body 62. A suitable bollard cover is described in U.S. Design Pat. No. D485,374. The bollard cover 104 blocks access to the one or more access holes 68*a*, 68*b* as well as improving the appearance of the adjustable bollard 60. The illustrative adjustable bollard 60 is removable by using the adjustment mechanism 76 to adjust the predetermined distance $D_1$ "unlocking" the bollard and pulling the bollard up out of the mounting holes 98*a*, 98*b*. If the bollard needs to be temporarily removed the two mounting holes 98*a*, 98*b* left behind do not present the level of floor hazard that single, larger diameter hole would present.

Although FIGS. 8A through 12B depict an adjustable bollard that is an illustrative embodiment of the present invention, one of ordinary skill in the art recognizes that many other embodiments of an adjustable bollard fall within the scope of the present invention. In particular, according to aspects of the present invention, the adjustable bollard can have more than two leg portions and there can be more that one adjustment mechanism that adjusts more than one predetermined distance between the more than two leg portions. The leg structure of the adjustable bollard can be substantially taller or shorter relative to a height of the rigid post body. The leg structure can be secured to an external side of the wall of the rigid post body or otherwise attached to the rigid post body. As shown in FIG. 13, embodiments of the adjustable bollard 160, 162 164 may have rigid post bodies 161, 163, 165 with cross-sections that are substantially polygonal instead of circular or elliptical. One embodiment of an adjustable bollard 160 has a substantially square cross-section of the rigid post body 161, another embodiment of an adjustable bollard 162 has a substantially hexagonal cross section of the rigid post body 163, and a third embodiment of an adjustable bollard 164 has a substantially octagonal cross section of the rigid post body 165. The example embodiments depicted are only some of the variations of an adjustable bollard that fall within the scope of the present invention.

Numerous modifications and alternative embodiments of the present invention will be apparent to those skilled in the art in view of the foregoing description. Accordingly, this description is to be construed as illustrative only and is for the purpose of teaching those skilled in the art the best mode for carrying out the present invention. Details of the structure may vary substantially without departing from the spirit of the invention, and exclusive use of all modifications that come within the scope of the appended claims is reserved.

What is claimed is:

1. A bollard, comprising:

a rigid post body having a base portion at a first end and a top portion at a second opposite end;

a leg structure secured to the rigid post body proximal to the base portion, the leg structure including at least two leg portions adapted to support the rigid body post body of the bollard, the at least two leg portions separated by a predetermined distance; and an adjustment mechanism coupled to the rigid post body and/or the at least two leg portions;

wherein the adjustment mechanism is configured to apply a force to the rigid post body to flex the rigid post body to reduce the predetermined distance; and wherein the adjustment mechanism is configured to apply a force to the rigid post body to flex the rigid post body to increase the predetermined distance;

whereby the bollard is placed into a desired configuration for installation.

2. The bollard of claim 1, wherein the adjustment mechanism comprises:

a cylindrical portion with a first end, a second end, and a cylindrical axis extending through the center and along the length of the cylindrical portion, wherein the cylindrical portion is threaded in a first orientation at a first end and wherein the cylindrical portion is reverse threaded at a second end;

a first coupling configured to couple the threaded first end of the cylindrical portion to the rigid post body; and a second coupling configured to couple the threaded second end of the cylindrical portion to the rigid post body;

wherein rotation of the cylindrical portion about the cylindrical axis in a first direction applies the force to flex the rigid post body to reduce the predetermined distance, and wherein rotation of the cylindrical portion about the cylindrical axis in a second direction applies the force to flex the rigid post body to increase the predetermined distance.

3. The bollard of claim 1, wherein the rigid post body is formed of a material with a yield strength of greater than about 150 MPa.

4. The bollard of claim 3, wherein the rigid post body is formed of a composite material.

5. The bollard of claim 3, wherein the rigid post body is formed of a metal.

6. The bollard of claim 1, wherein the rigid post body is formed of a steel.

7. The bollard of claim 1, wherein a cross-section of the rigid post body, viewed along a central axis of rigid post body, is substantially circular or elliptical.

8. The bollard of claim 1, wherein a cross-section of the rigid post body, viewed along a central axis of the rigid post body, is substantially polygonal.

9. The bollard of claim 1, wherein the leg structure is secured to an inner side of a wall of the rigid post body.

10. The bollard of claim 1, wherein the rigid post body is secured to the leg structure by at least one weld.

11. The bollard of claim 10, wherein the rigid post body further comprises, at least one slot parallel to a central axis of the rigid post body, wherein the at least one weld securing the rigid post body to the leg structure is disposed at the at least one slot.

12. The bollard of claim 1, wherein the rigid post body further comprises at least one access hole, wherein the access hole allows access to the adjustment mechanism.

13. The bollard of claim 1, wherein the at least two leg portions are joined by the adjustment mechanism.

14. The bollard of claim 1, wherein the adjustment mechanism is adapted to apply a force to the bollard to flex the rigid post body to adjust the predetermined distance by a distance of at least about 0.25 inches.

15. The bollard of claim 1, further comprising a cover adapted to cover the rigid post body and block access to the at least one access hole.

16. The bollard of claim 1, further comprising a containing wall disposed in the rigid post body, oriented substantially perpendicular to a wall of the rigid post body and in contact with the rigid post body, the containing wall forming a bottom of a container for containing ballast.

* * * * *